US006220485B1

(12) United States Patent
Chang

(10) Patent No.: US 6,220,485 B1
(45) Date of Patent: Apr. 24, 2001

(54) EXTENDED PIGGYBACK DISPENSING DEVICE WITH INTERCHANGEABLE APPLICATION GUIDES

(76) Inventor: Peter J. Chang, 11001 Petersborough Dr., Rockville, MD (US) 20852

( * ) Notice: Subject to any disclaimer, the term of this patent is extended or adjusted under 35 U.S.C. 154(b) by 0 days.

(21) Appl. No.: 09/351,854

(22) Filed: Jul. 12, 1999

Related U.S. Application Data

(60) Provisional application No. 60/130,150, filed on Apr. 20, 1999, and provisional application No. 60/119,477, filed on Feb. 9, 1999.

(51) Int. Cl.[7] ..... B67D 5/64

(52) U.S. Cl. ..... 222/174; 222/327; 401/48; 401/193

(58) Field of Search ..... 222/174–327; 401/48, 193

(56) References Cited

U.S. PATENT DOCUMENTS 3,981,595 * 9/1976 Blake ..... 401/48
4,932,565 * 6/1990 Paradiso ..... 222/174
5,984,557 * 11/1999 Fennell ..... 401/193

* cited by examiner

*Primary Examiner*—Philippe Derakehani
(74) *Attorney, Agent, or Firm*—Law Offices of Royal W. Craig

(57) ABSTRACT

An improved piggyback dispensing feature for extended dispensing devices of tile type having a housing with a downwardly extending handle, a trigger pivoted to the handle, an extension bracket attached forwardly of the housing, a barrel assembly attached to the extension bracket opposite the housing, and a piston rod slidably supported in the housing and extension bracket and protruding into the barrel assembly. The improvement comprises an interchangeable push-disk piston mounted on the distal end of the piston rod, and a smaller barrel assembly adapted to be seated inside the other larger barrel assembly to accommodate a smaller-sized cartridge. The smaller barrel assembly piggybacks in the larger, and the push-disk piston swaps out, thereby making it possible to use one extended gun for at least two different-sized cartridges, such as the typical ¼ gallon cartridges and ⅒th gallon cartridges. A variety of interchangeable/adjustable quick-change guide assemblies are also shown for guiding the application of a bead of caulk or adhesive along trusses, joists and other structural components.

23 Claims, 11 Drawing Sheets

EXTENDED PIGGYBACK DISPENSING DEVICE WITH INTERCHANGEABLE APPLICATION GUIDES

CROSS-REFERENCE TO RELATED APPLICATIONS

The present application is based on U.S. Provisional Application 60/130,150 by Chang, Peter J., filed: Apr. 20, 1999, and on U.S. Provisional Patent Application No. 60/119,477 by Chang, Peter J., for his "Adjustable Dispensing Gun Application Guide", filed: Feb. 9, 1999.

BACKGROUND OF THE INVENTION

1. Field of the Invention

The present invention relates to dispensing devices and, more particularly, to an extended dispensing device for application of a bead of caulk or adhesive along hard to reach structural components. The extended dispensing device employs a repairable design with easy to replace components, interchangeable barrels to accept different caulk cartridges, and interchangeable application guides for guiding the application of a bead of caulk or adhesive along trusses, joists and other structural components.

2. Description of the Background

There are many types of conventional caulk guns all used to dispense a variety of fluid compounds including urethane, vinyl, polyester, epoxy and other plastics or resins. Some of these caulk guns are specially adapted for a particular purpose. One example of a specialty caulk gun is the extended gun that is commonly used in the roofing and flooring context. Extended caulk guns have a barrel, nozzle and cartridge that are separated from the trigger and driving mechanism by an elongated extension, thereby enabling operation of the gun at a distance from where the bead of caulk is applied. This allows an extended reach when compound must be applied to remote areas, such as overhead joists or trusses. Extended caulk guns provide great utility to the flooring and roofing industry. However, different flooring or roofing jobs present different requirements, and extended guns offer very little flexibility. For instance, a larger quart-size cartridge should be used for a longer run job to save costs and avoid frequent cartridge replacement. On the other hand, a smaller 1/10th gallon cartridge should be used for short run jobs. Otherwise, the unused portion of the cartridge goes to waste. Conventional extended guns are made to accommodate either the typical ¼ gallon cartridges or 1/10th gallon cartridges, but not both. Since the extended caulk guns are specialty items, they are relatively expensive to purchase and it is impractical to buy two (one for the ¼ gallon cartridge and one for the 1/10th gallon cartridge). The expense of extended guns also promotes a market for replacement and repair parts, but existing extended guns are generally not repairable. They typically use a welded and/or riveted design and make no provision for swapping out worn parts. Accordingly, there remains a demand for a more flexible extended dispensing gun in which parts are interchangeable to facilitate repair, and which is capable of accommodating at least two different-sized cartridges such as the typical ¼ gallon cartridges and 1/10th gallon cartridges.

In addition to the above-described expense of extended guns, their length makes them difficult to maneuver because the weight of the caulk cartridge must be supported at the end of the elongate extension. It is known to mount a caulk application guide at the distal end of the barrel underneath the nozzle to support the cartridge and ensure that a bead of caulk is properly applied. For example, U.S. Pat. No. 4,932,565 to Paradiso shows an extended reach caulking gun with an application guide 24 mounted at the distal end (Paradiso FIG. 1). The guide takes the form of a U-shaped member which is screwed or riveted to the underside of the gun at the barrel end. The U-shaped guide is adapted to straddle and ride along a joist or truss thereby helping to apply the compound in a straight line and with improved accuracy. The U-shaped guide assists in applying compound along studs, rafters and other building components that call for the application of compound along a defined path. Unfortunately, the fixed span of the U-shaped guide 24 is only capable of accommodating studs of a particular size. The guide 24 cannot straddle double studs or many other types of components such as window sills or roof seams. While Paradiso '565 goes on to suggests other guide configurations (see FIGS. 5–7) to accommodate other components, these are not interchangeable and the gun cannot be easily adapted for a particular job.

Accordingly, there is also a demand for an extended gun having interchangeable guide members, inclusive of an adjustable guide member, to facilitate quick and easy adaptation for different types of jobs and for applying compound along different types of building components.

SUMMARY OF THE INVENTION

It is, therefore, an object of the present invention to provide an extended piggyback dispensing device that is capable of accommodating at least two different-sized cartridges, such as the typical ¼ gallon cartridges and 1/10th gallon cartridges. The smaller cartridge may be used for short run jobs while the larger cartridge serves for long run jobs, and the ability to change between the two prevents wasted compound.

It is another object to provide a variety of improved caulk gun application guide assemblies and a means for attachment of the same to the above-described piggyback dispensing device to instantly adapt the guide for guidance along different types of building components.

It is still another object to provide an extended piggy-back feature and interchangeable caulk gun guide assemblies as described above all of which can be readily retrofit to an existing extended caulk gun.

It is another object to provide purchasers of the above-described gun with the lasting value of an extremely flexible design that allows effortless repair of worn parts, swapping out of caulk gun guide assemblies, and swapping out of barrels for different-sized cartridges.

According to the present invention, the above-described and other objects are accomplished by providing a piggyback dispensing feature for extended dispensing devices. The piggyback feature may be incorporated in any conventional extended dispensing device of the type generally comprising a housing having a downwardly extending handle, an extension bracket attached forwardly of the housing, a barrel assembly attached to the extension bracket opposite the housing, a piston rod slidably supported in the housing and extension bracket and protruding into the barrel assembly. The improvement comprises an interchangeable push-disk piston mounted on the distal end of the piston rod, and a smaller barrel assembly adapted to be seated inside the other larger barrel assembly to accommodate a smaller-sized cartridge. The piggyback barrel assembly makes it possible to use one extended gun for at least two different-sized cartridges, such as the typical ¼ gallon cartridges and 1/10th gallon cartridges.

A number of interchangeable/adjustable guide members are also shown for attachment to the dispensing gun to guide the application of a bead of caulk or adhesive along trusses, joists and other structural components. The multiple interchangeable guide members facilitates quick and easy adaptation for different types of jobs and different types of building components.

The guide assembles include a quick-change guide assembly that allows a quick-change reversal to accommodate either a single joist or a double joist position.

The guide assemblies also include an adjustable guide with opposing legs that are readily adjustable by hand and on-the-fly to accommodate large-width and double-trusses and joists.

All of the guide assemblies can be secured to the dispensing gun by a quick-change detent-lock to allow quick reversal or swapping out to accommodate single joist, double joist, and other structural components.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
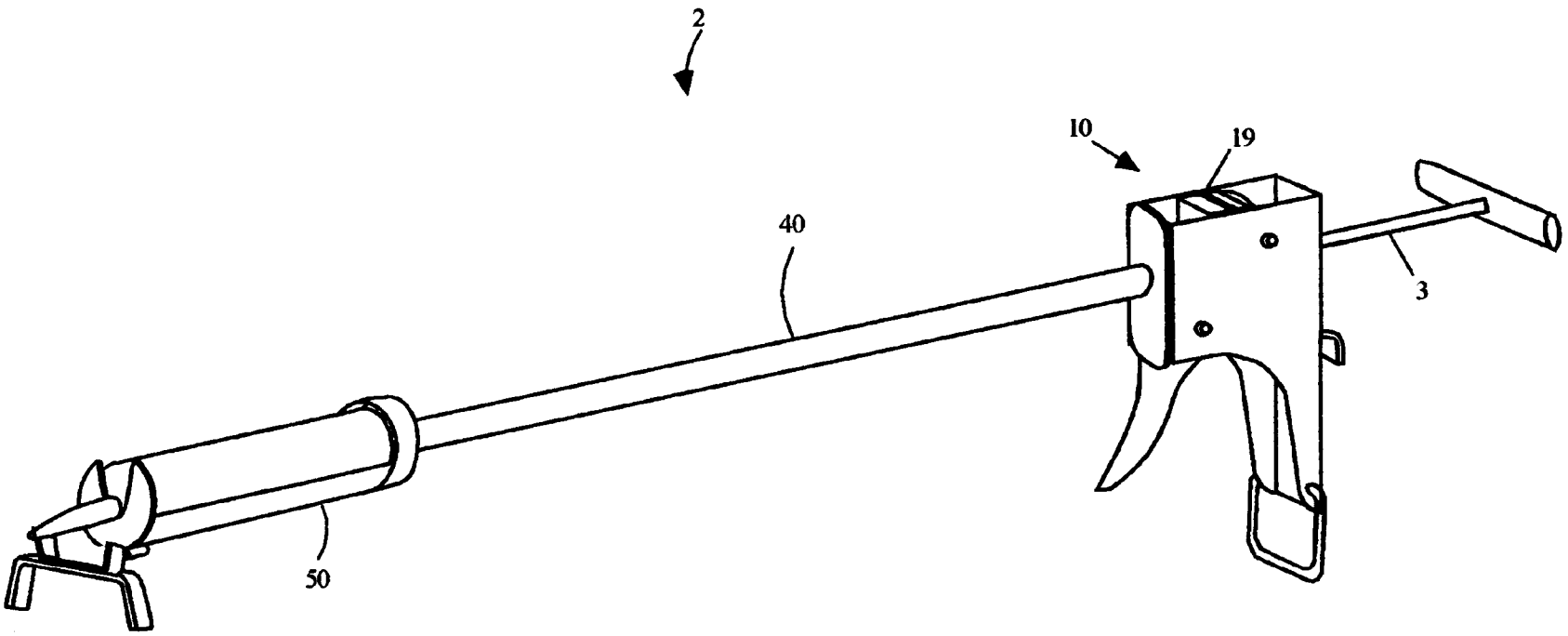
FIG. 1 is a perspective view of extended piggyback dispensing device 2 according to one embodiment of the present invention.

FIG. 1 is a perspective view of extended piggyback dispensing device 2 according to one embodiment of the present invention.

The dispensing device 2 is a manual trigger-operated device incorporating a conventional single-direction gripping assembly 19 that is incorporated in a rear housing 10. Existing dispensing guns employ a number of different gripping assembly configurations and housing styles, including closed-frame housings (as shown) and open-frame housings. All are suitable for use with the present invention. The single-direction gripping assembly 19 urges an elongate piston rod 3 outwardly through an elongate extension bracket 40 and into a larger barrel assembly 50. In the illustrated embodiment, the larger barrel assembly 50 is sized to accept a conventional 1/4 gallon cartridge.

Figure 2:
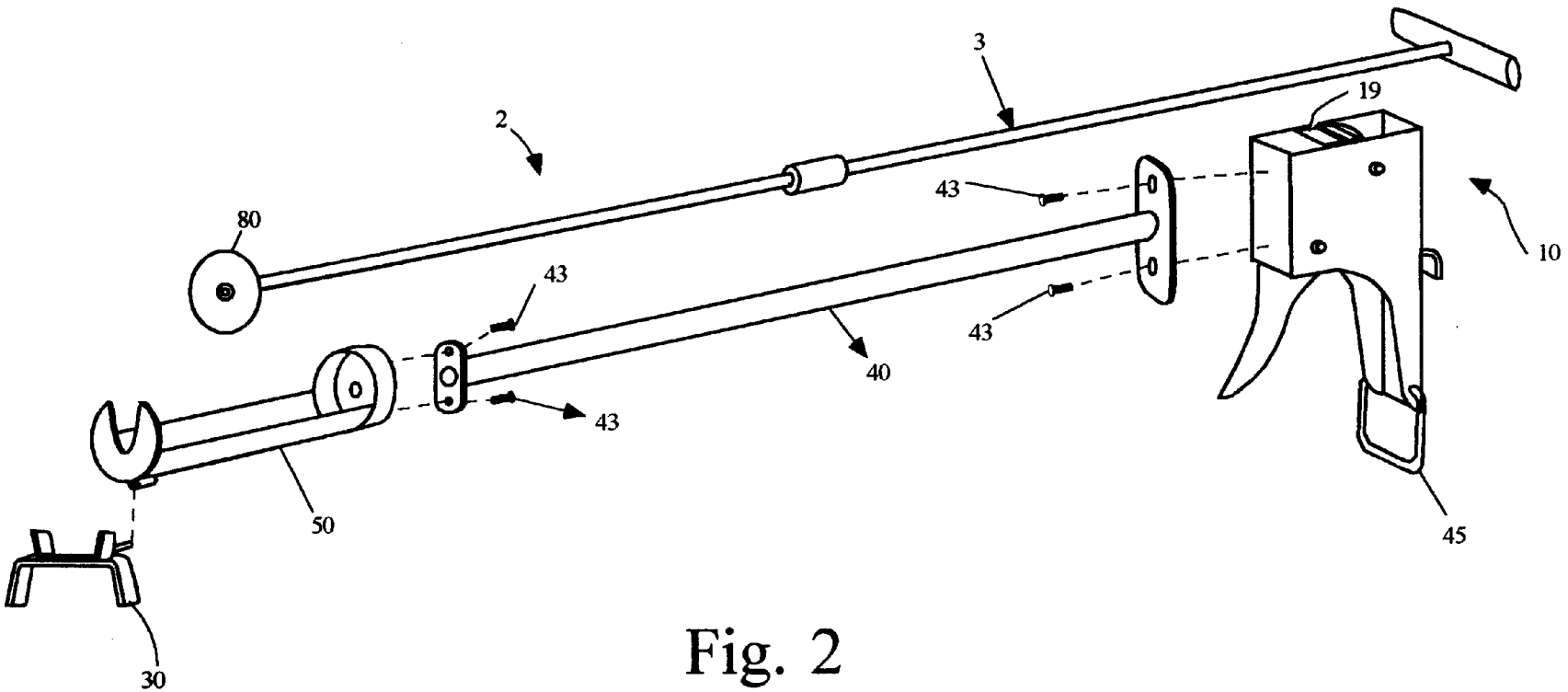
FIG. 2 is an exploded perspective view of the extended piggyback dispensing device 2 as in FIG. 1.

FIG. 2 is an exploded perspective view of the extended piggyback dispensing device 2 as in FIG. 1. An interchangeable push-disk piston 80 is secured to the end of the piston rod 3, and the interchangeable push-disk piston 80 drives through the cartridge along barrel assembly 50 to exude compound from the nozzle. The illustrated dispensing device 2 is shown with a 2-in-1 back-to-back guide assembly 30 (to be described) that is attached to the front underside of the barrel 50 to guide application of a bead of caulk along structural components.

In accordance with the present invention, the interchangeable push-disk piston 80 can be removed from the end of piston rod 3, and the piston rod 3 withdrawn to the very end of barrel assembly 50. A smaller barrel assembly can then be inserted inside the larger barrel assembly 50 to accommodate a smaller-sized cartridge. This avoids waste during smaller jobs.

The juncture of extended bracket 40 with housing 10 is also shown. Simple hex screw/bolt combinations 43 are used to allow convenient disassembly for replacement of worn or broken parts. A "D" ring 45 is placed on the end of the handle in order to hold the trigger together when loading a new cartridge. To load a cartridge, the trigger can be locked by the "D" ring 45 by sliding the "D" Ring 45 over the tip of the trigger. This enables a new cartridge to be loaded without the piston rod 3 slipping down. The design facilitates complete disassembly and effortless repair of worn parts. The 1/4 gallon barrel assembly 50 is removably secured to the extension bracket 40 by hex bolts or the like. The extension bracket 40 may include one (as shown) or two parallely-spaced hollow steel tubes that are held together at both ends by steel plates. A passage is provided through the plate and in one of the steel tubes in order to pass the piston rod 3. In the case of double tubes, the second tube serves as reinforcement.

Figure 3:
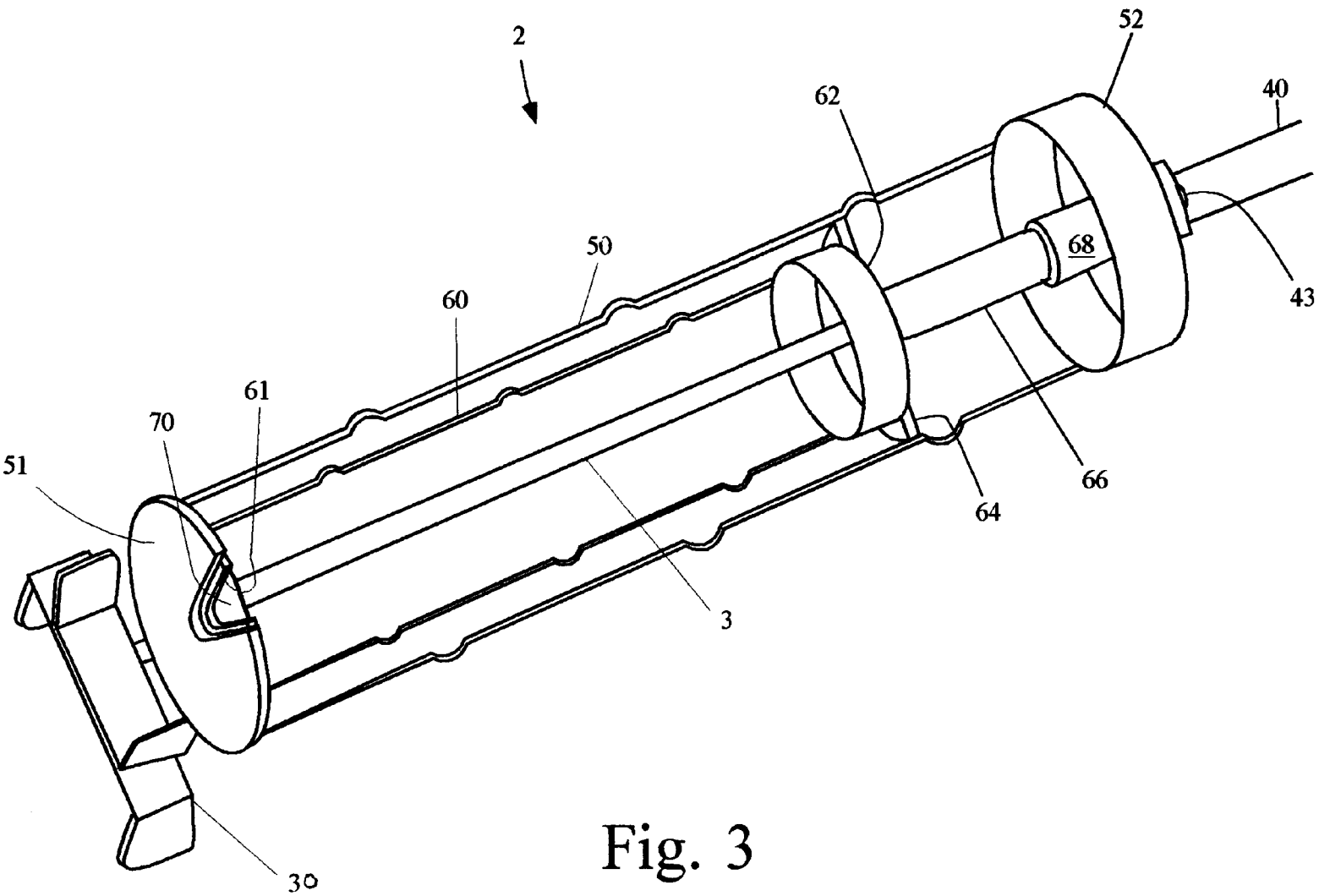
FIG. 3 is a close-up perspective drawing of the extended piggyback dispensing device 2 with a smaller 1/10th gallon barrel assembly 60 attached inside of the 1/4 gallon barrel assembly 50.

FIG. 3 is a close-up perspective drawing of the extended piggyback dispensing device 2 with a smaller 1/10th gallon barrel assembly 60 attached inside of the 1/4 gallon barrel assembly 50. This is accomplished by seating the smaller 1/10th gallon barrel assembly 60 inside the 1/4 gallon barrel assembly 50, and then reinserting piston rod 3 through smaller barrel assembly 60. The distal end of the piston rod 3 is then equipped with a different (smaller) interchangeable push-disk piston 70. In just a few short moves, the extended dispensing gun 2 is converted for use with one of two different-sized cartridges such as the illustrated ¼ gallon cartridge and 1/10th gallon cartridge. In effect, the 1/10th gallon barrel assembly 60 "piggybacks" inside of the ¼ gallon barrel assembly 50. Both of the 1/10th gallon barrel assembly 60 and ¼ gallon barrel assembly 50 are half-barrel assemblies for seating appropriately-sized caulk or other fluid compound cartridges. Both of barrel assemblies 50, 60 are partially closed at the leading end by retaining walls 51, 61, respectively. The retaining walls 51, 61 are defined by a downward yoke for seating the plastic tips of the respective 1/10th gallon and ¼ gallon cartridges. Both barrel assemblies 50, 60 are closed at the other ends by caps 52, 62, respectively, both caps 52, 62 being annular steel members with centrally-aligned apertures to pass the piston rod 3.

The two different-sized barrel assemblies 50, 60 are suited for different-sized caulking jobs. For instance, the smaller cartridge may be used for short run jobs while the larger cartridge serves for long run jobs.

Just as the size of the job may vary, so to might the structural requirements. For example, either single joists and trusses or double joists and trusses may be used in the construction of dwellings. To accommodate single joists and trusses as well as double joists and trusses, a 2-in-1 back-to-back guide assembly 30 is attached to the front underside of the barrel 50. The end cap 52 of the larger barrel assembly 50 is removably secured to one end plate of the extension bracket 40 (with the piston rod 3 protruding inside the larger barrel assembly 50), while the other end plate of the extension bracket 40 is screwed directly to the main housing 10.

Figure 4:
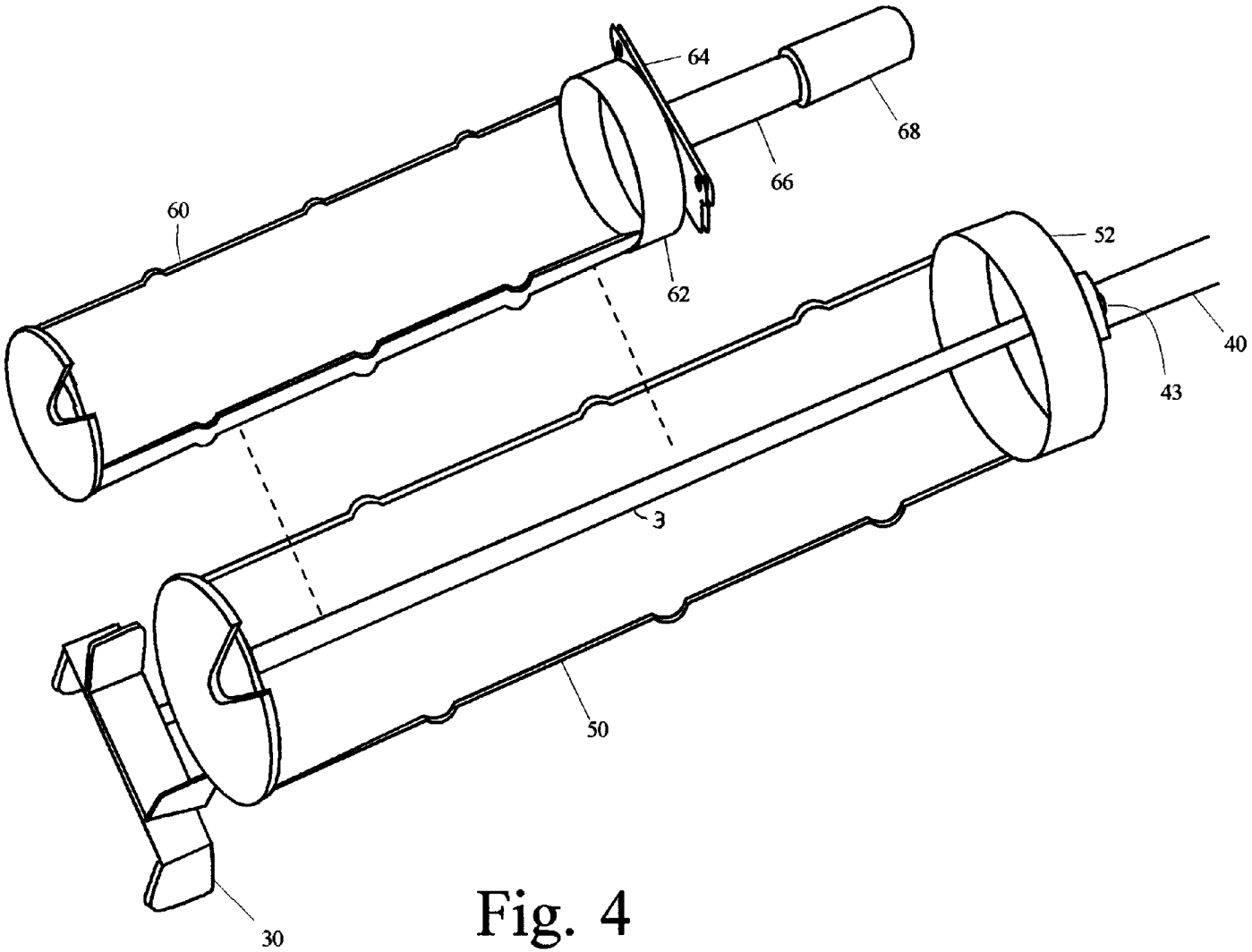
FIG. 4 is a close-up perspective view of the 1/10th gallon barrel assembly 60 with dotted lines showing how it is to be seated in the 1/4 gallon barrel assembly 50.

FIG. 4 is a close-up perspective view of the 1/10th gallon barrel assembly 60 with dotted lines showing how it is to be seated in the ¼ gallon barrel assembly 50. The 1/10th gallon barrel assembly 60 is laterally secured inside of the ¼ gallon barrel assembly 50 by a stabilizer bar 64.

Figure 5:
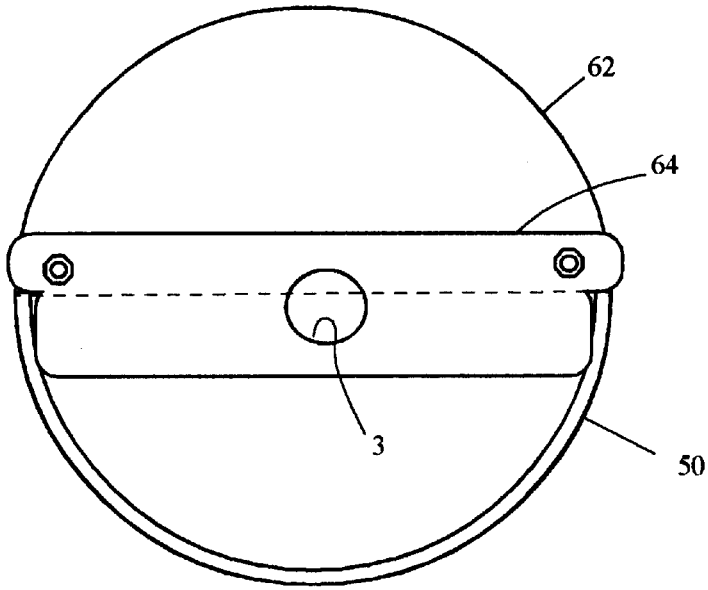
FIG. 5 is a front view of the stabilizer bar 64 as shown in FIG. 4. The stabilizer bar 64 is a strip of metal that straddles the piston rod 3 and is screwed directly to cap 62.

FIG. 5 is a front view of the stabilizer bar 64 as shown in FIG. 4. The stabilizer bar 64 is a strip of metal that straddles the piston rod 3 and is screwed directly to cap 62. The outward ends of the stabilizer bar 64 conform to the curvature of the barrel assembly 50 and function to line up the smaller barrel assembly 60 within the larger barrel assembly 50. This ensures that the piston rod 3 will pass straight through a tubular extension 66 (seen in FIG. 4). The tubular extension 66 is anchored to the backside of the stabilizer bar 64, and this imparts a secure longitudinal seating of the smaller barrel assembly 60. The tubular extension 66 provides a footing against the end cap 52, and is equipped with a spring-loaded collar 68 for biasing the smaller barrel assembly 60 against the front of the larger barrel assembly 60. Piston rod 3 will pass straight through tubular extension 66 and into the smaller barrel assembly 60.

Figure 6:
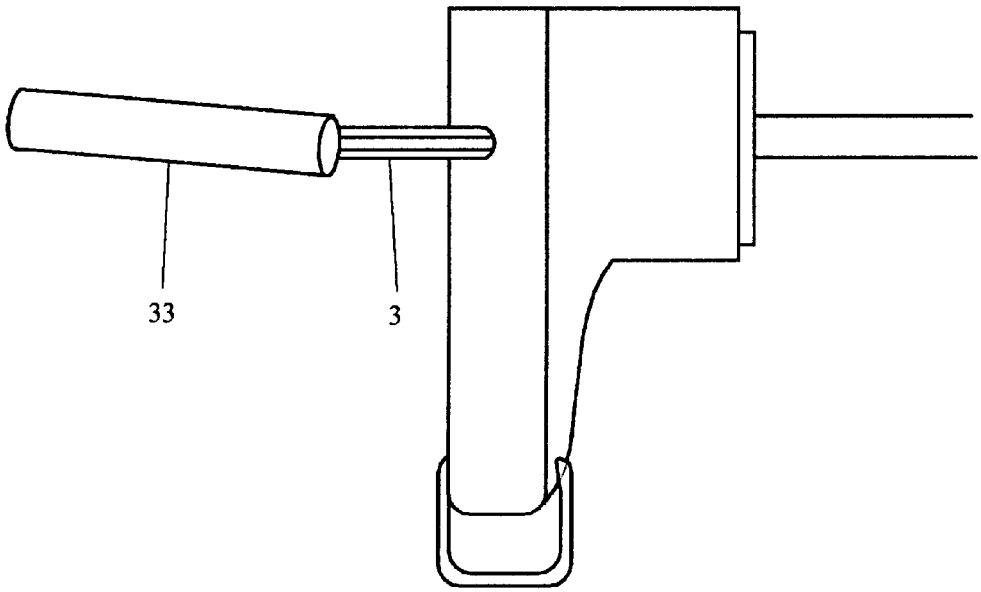
FIG. 6 is a perspective view of the rear housing 10 of the extended piggyback dispensing device 2 which incorporates a hexagonal piston rod 3 having a handle 33 threaded onto the end.

FIG. 6 is a perspective view of the rear housing 10 of the extended piggyback dispensing device 2 which incorporates a hexagonal piston rod 3 having a handle 33 threaded onto the end. Either a circular, hexagonal or square piston rod may be used as will be appreciated by those skilled in the art. Moreover, discrete piston rod segments may be used as will be described to simplify repair and replacement.

Figure 7:
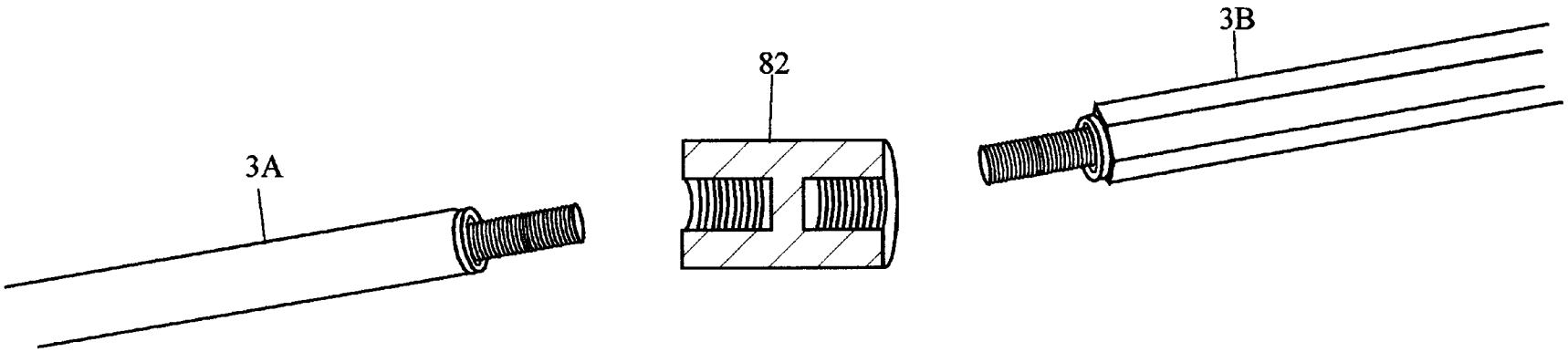
FIG. 7 is a side perspective view of optional coupling 82 to join discrete piston rod segments.

FIG. 7 is a side perspective view of optional coupling 82 to join discrete piston rod segments. The preferred overall rod 3 length is approximately 43". A segmented piston rod feature allows the use of normal (less expensive) piston rod segments to manufacture the extended dispensing device 2. The piston rod 3 can be formed in as many segments as desired, and all of the segments can be coupled together via couplings 82 with threaded bore holes at each end. In each case, the segments of piston rod 3 are likewise threaded at the ends for screw insertion into couplings 82. Hex segments 3A can be joined to round segments 3B or to square segments as desired. This segmented design reduces manufacturing costs. In addition, when a rod segment wears out it is much easier and less expensive to replace. Moreover, the segmented configuration also allows the reversal of segments within the gun 2 in order to prolong the life of the piston rod.

Figure 8A:
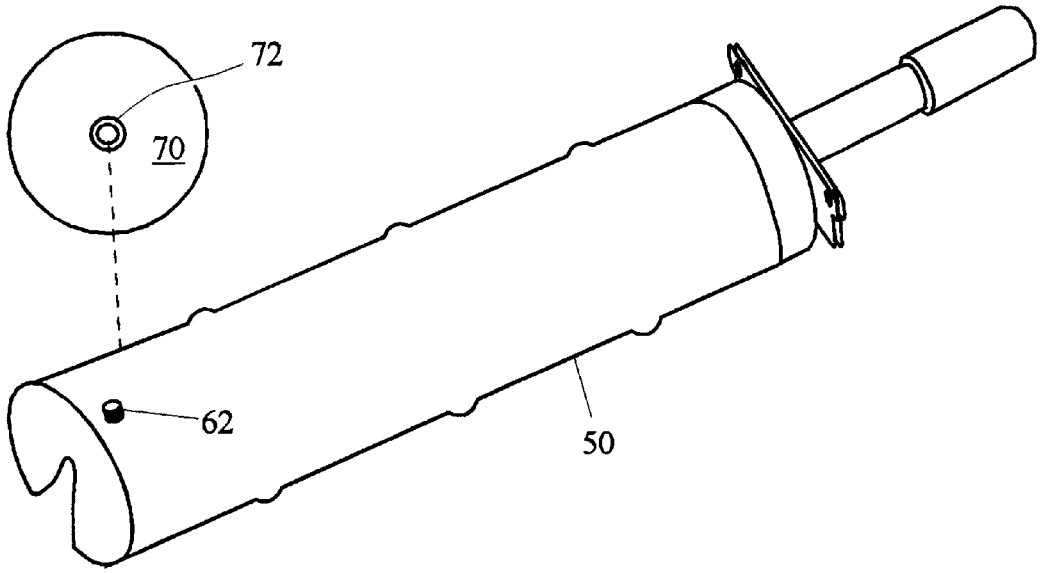
FIG. 8A is a close-up composite view of the underside of the 1/10th gallon piggyback barrel assembly 60 illustrating by dotted lines how the idle push-disk piston 70 is removably secured.

FIG. 8A is a close-up composite view of the underside of the 1/10th gallon piggyback barrel assembly 60 illustrating by dotted lines how the idle push-disk piston 70 is removably secured. The push-disk piston 70 (and identical but larger diameter push-disk piston 80) are both conventional cupped pistons that are sized appropriately for the intended cartridge. Both are provided with a centrally-threaded coupling 72 to allow screw attachment and removal to/from the threaded end of the piston rod 3.

Figure 8B:
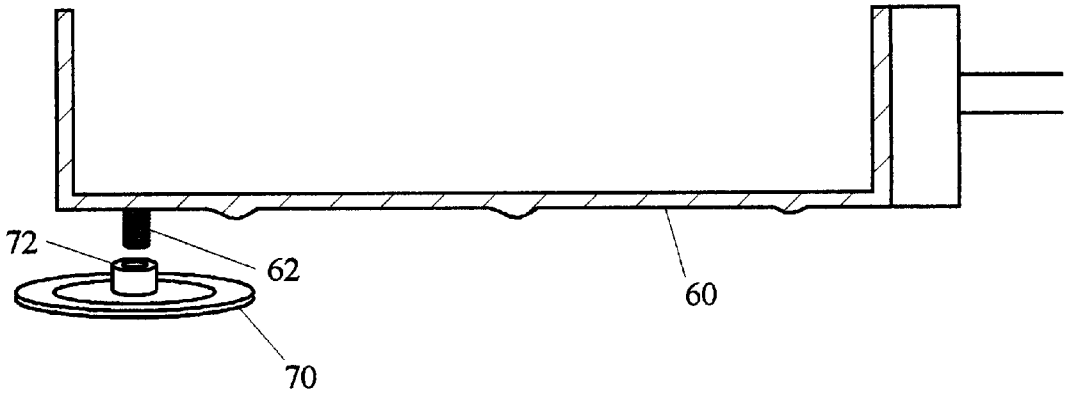
FIG. 8B is a side cross section of the 1/10th gallon piggyback barrel assembly 60 again illustrating how the push-disk piston 70 is secured.

FIG. 8B is a side cross section of the 1/10th gallon piggyback barrel assembly 60 again illustrating how the push-disk piston 70 is secured. As shown in FIG. 8B a threaded stud 62 projects downwardly from the underside of the 1/10th gallon piggyback barrel assembly 60. This allows the user to screw on the idle push-disk piston 70 when not in use, thereby avoiding lost parts. The threaded stud 62 may be screwed into the underside of the 1/10th gallon piggyback barrel assembly 60 by more or less to thereby vary the extent by which it projects downwardly from the barrel assembly 60. Given this adjustability, stud 62 serves the dual purpose of acting as an adjustable vertical spacer between the ¼ gallon barrel assembly 50 and the 1/10th gallon piggyback barrel assembly 60.

The operation of swapping out barrel assemblies will now be described with reference to all of FIGS. 1–8. Interchangeable push-disk piston 80 is removed from the end of piston rod 3. The piston rod 3 is withdrawn all the way to the end of the ¼ gallon barrel assembly 50. The smaller 1/10th gallon barrel assembly 60 is seated inside the ¼ barrel assembly 50, and the spring-loaded collar 68 of the tubular extension 66 is aligned with the hole in the end cap 52. The user pushes the smaller 1/10th gallon barrel assembly 60 down to ensure that it is seated on the bottom of the ¼ barrel 50. The front walls of the barrel assemblies 50, 60 should be aligned, and then the smaller push-disk piston 70 is screwed to the end of piston rod 3.

The above-described design provides an extended piggyback dispensing capable of accommodating at least two different-sized cartridges, including standard ¼ gallon cartridges and 1/10th gallon cartridges. All parts are 100% replaceable, and this has not been possible with any comparable unit on the market. The advantages are as follows: 1) at the price of one gun, the user can have the functionality of two guns; 2) the device saves carrying space, either in toolbox or in a truck; 3) the user need only carry one extended gun on a ladder to the roof or any job site, rather than two unwieldy guns; 4) savings in compound due to not being limited to a larger cartridge.

The full ability to adapt the foregoing dispensing device to a variety of different jobs calls for a variety of interchangeable and/or adjustable guide members for applying compound along different types of building components. One useful guide member is the 2-in-1 back-to-back guide assembly 30 that has been shown attached to the front underside of the barrel 50.

Figure 9:
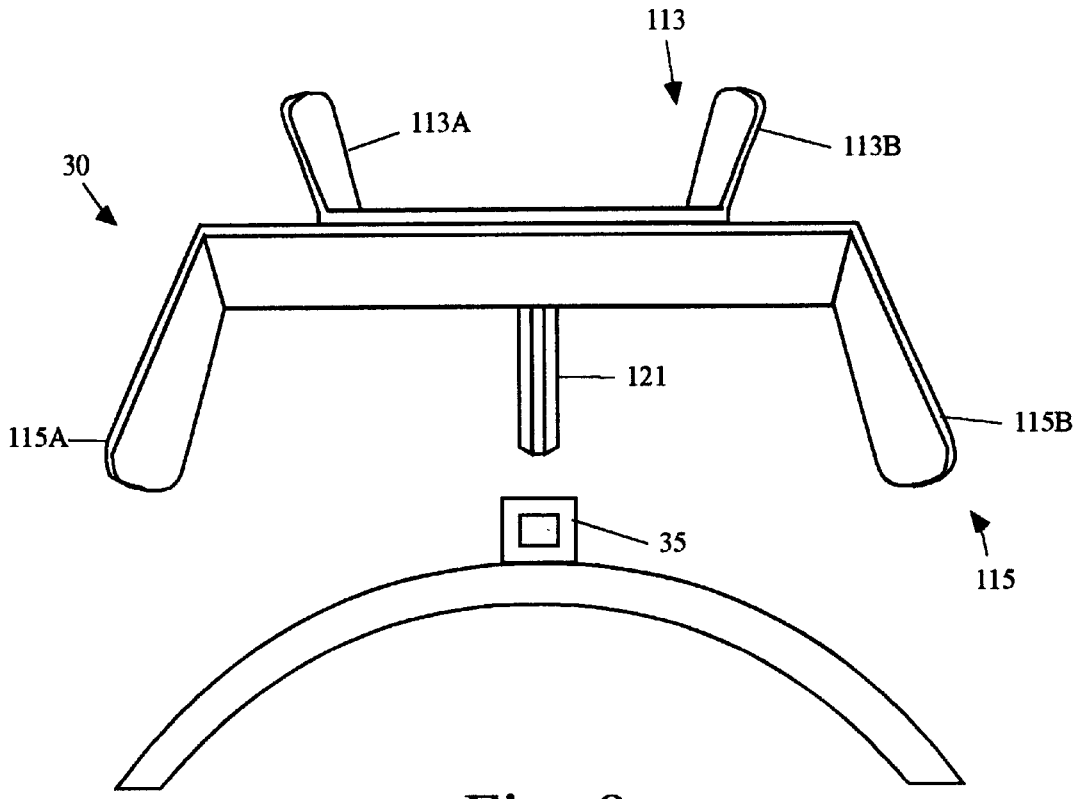
FIG. 9 is a front perspective drawing showing the upper guide 113 that comprises opposing legs 113A and 113B that are separated and flared outwardly by a sufficient measure to ride along a single joist.
Figure 10:
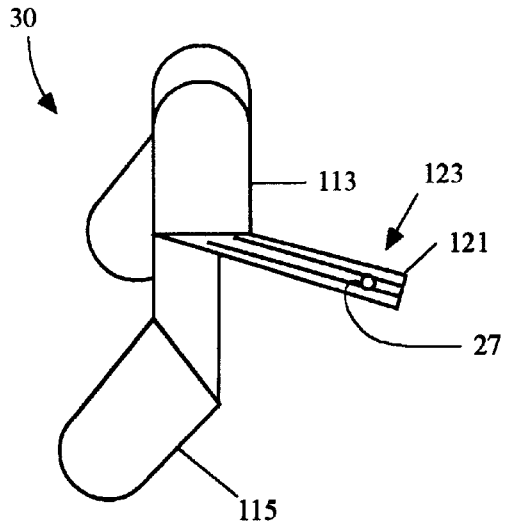
FIG. 10 illustrates the spring-loaded ball-detent mechanism 123 mounted in the distal end of the stem 121.
Figure 11:
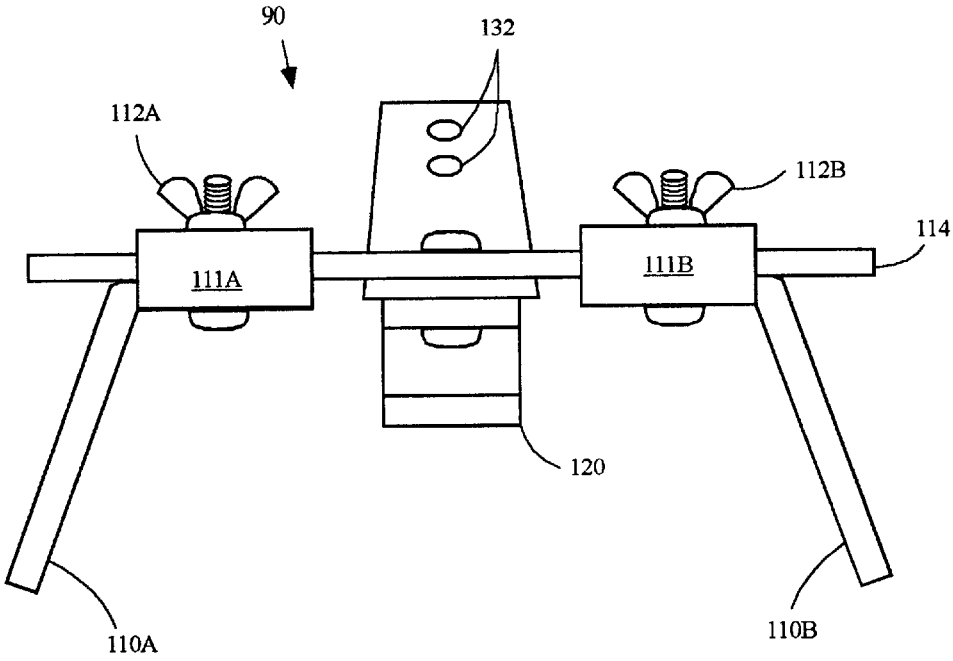
FIG. 11 is a perspective front view of an adjustable caulk gun guide assembly 90 according to the present invention.

FIGS. 9–11 further illustrate the 2-in-1 back-to-back guide assembly 30 as shown in the foregoing description. The 2-in-1 back-to-back guide assembly 30 offers the convenience of a quick-flip changeover to accommodate either a single joist of a double joist.

FIG. 9 is a front perspective drawing showing the upper guide 113 that comprises opposing legs 113A and 113B that are separated and flared outwardly by a sufficient measure to ride along a single joist. Also shown is the back-to-back lower guide 115 that comprises opposing legs 115A and 115B that are separated and flared outwardly by a sufficient measure to ride along a double joist. The upper guide 113 may be formed from a unitary steel member with bent legs 113A and 113B. Likewise, the lower guide 115 may be formed from a unitary steel member with bent legs 115A and 115B. Both the upper and lower guides 113, 115 are mounted (by welding or the like) to opposing sides of a stem 121 comprised of a length of hexagonal or rectangular steel rod.

As shown in FIG. 10, a spring-loaded ball-detent mechanism 123 is mounted in the distal end of the stem 121. Ball-detent mechanism 123 includes a spring mounted inside the steel rod of stem 121 in a known manner, the spring biasing a ball bearing against a small bore hole in the side of the steel rod. The ball bearing protrudes outward slightly from stem 121. A mating receptacle 35 is mounted on the front end of the caulk gun on the underside of the ¼ gallon barrel assembly 50, and this is equipped with a bore hole 36 that can be slidably aligned with the ball bearing 27. This way, as shown by dotted lines in FIG. 10, the 2-in-1 back-to-back guide assembly 30 is inserted by its undercarriage 21 into the mating receptacle 35 on the front end of the caulk gun, and the ball bearing 27 becomes seated in the bore hole 36 of the receptacle 35, thereby locking the 2-in-1 back-to-back guide assembly 30 in position.

In operation, the guide assembly 30 straddles the intended construction component (such as a joist, truss, etc.) and rides along the construction component as the user applies a uniform continuous bead of caulk. The straddled legs 113A and 113B permit rocking of the guide assembly 30 and gun maneuver the nozzle as desired, yet prevent the guide assembly 30 from being dislodged from the construction component. The 2-in-1 back-to-back guide assembly 30 can be quickly and conveniently snapped out of position, reversed, and snapped back into place to accommodate either a single joist or a double joist.

As an alternative to the 2-in-1 back-to-back guide assembly 3, FIG. 11 is a perspective front view of an adjustable caulk gun guide assembly 90 according to the present invention. Guide assembly 90 generally comprises a T-shaped undercarriage 114, a pair of adjustable downwardly extending legs 110A and 1103B, a pair of wing nut/screw combinations 112A and 112B for attaching the respective legs to the T-shaped bracket 114, and a forwardly-disposed guide member 120. The guide assembly 90 is removably attached beneath the barrel of the caulk gun with legs 110A and 110B protruding downwardly and guide member 120 protruding forwardly. Attachment of the guide assembly 90 beneath the barrel of the caulk gun may be accomplished with the a locking receptacle configuration as described above, or by rivets, screws, or any other known manner.

Figure 12:
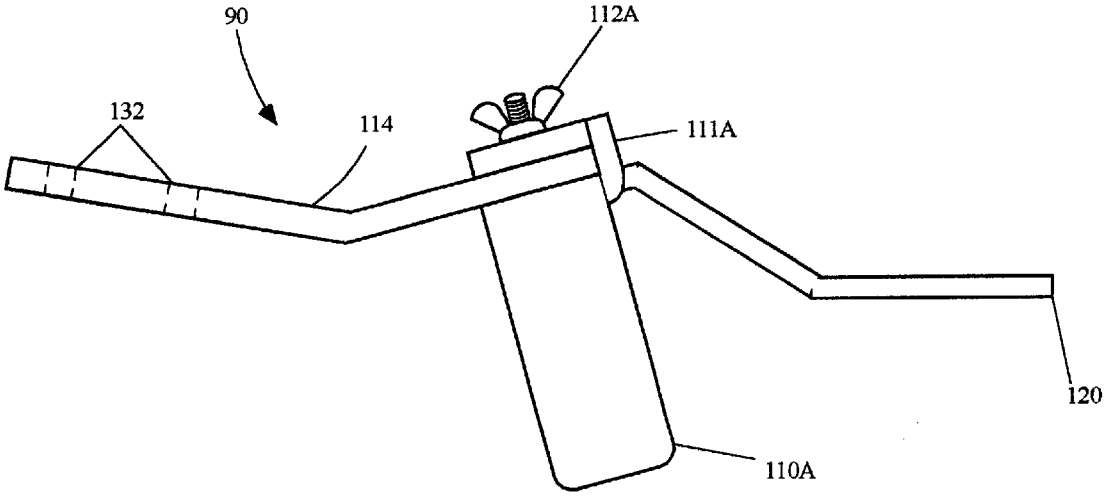
FIG. 12 is a perspective side view of the adjustable caulk gun guide assembly 90 as in FIG. 11.
Figure 13:
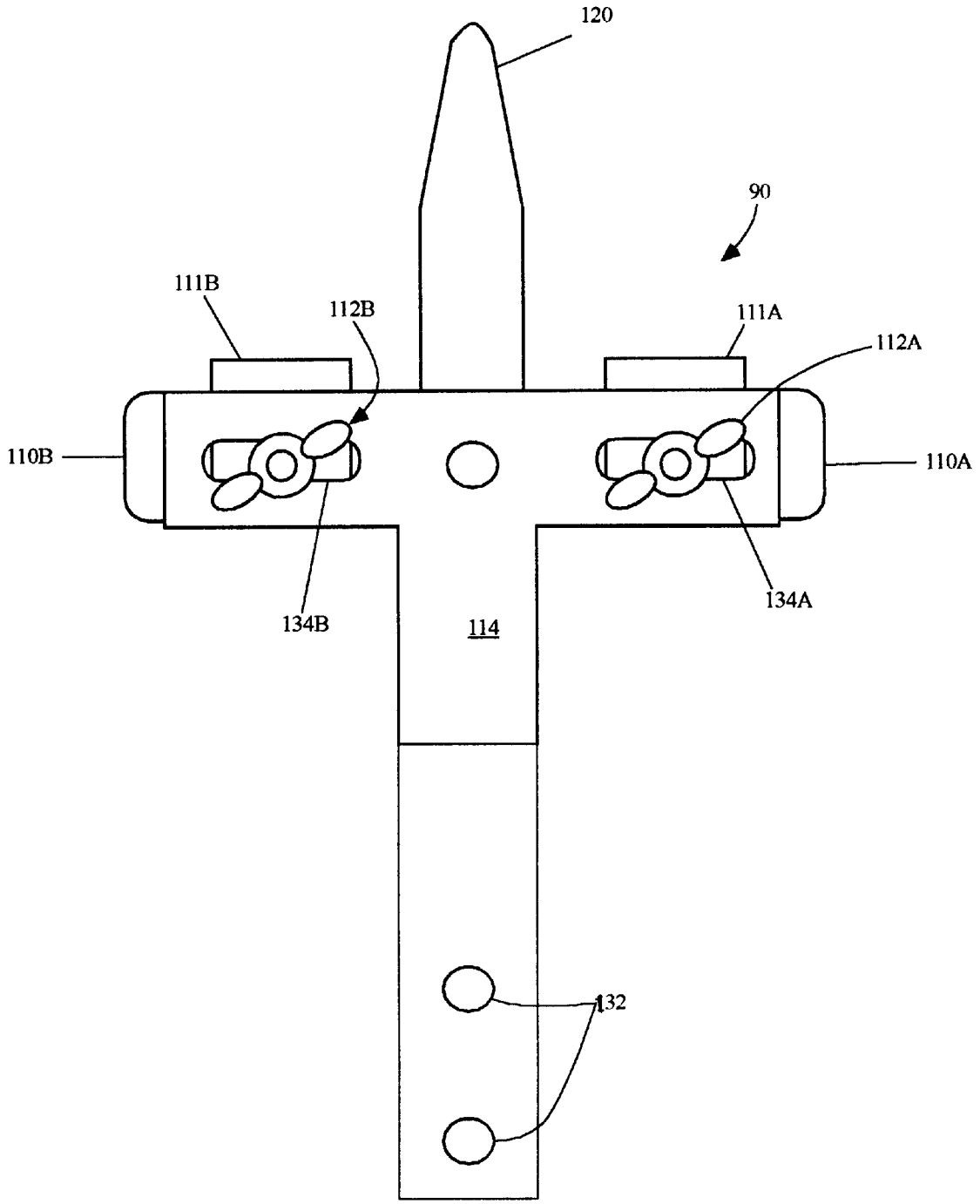
FIG. 13 is a perspective view of the adjustable caulk gun guide assembly 90 as in FIG. 12.

FIG. 12 is a perspective side view and FIG. 13 is a perspective top view of the adjustable caulk gun guide assembly 90 as in FIG. 11. The T-shaped undercarriage 114 may include a pair of bore-holes 132 through the stem portion for screw-attachment to the underside of the caulk gun barrel. The outwardly extended arms of the T-shaped undercarriage 114 are defined by opposing oblong slots 134A and 134B. Slots 134A and 134B are adapted to pass the screws of the respective wing nut/screw combinations 112A and 112B. The wing nut/screw combinations 112A and 112B are also anchored to the legs 110A and 110B, and given this configuration the legs can be adjusted lengthwise along the outwardly extended arms of the T-shaped undercarriage 114 within opposing slots 134A and 134B. Thus, the legs 110A and 110B can be adjusted to a desired spacing to accommodate trusses and/or joists of different dimensions. Specifically, given a 1" slot 134A and 134B as shown, the guide 90 can be conveniently adjusted on-the-fly to straddle a standard 1.5" single and 3.5" double floor trusses, joists, etc.

To further facilitate adjustment, the legs 110A and 110B are formed as mirror-opposite members each protruding downwardly from a horizontal section that slidably abuts the underside of the T-shaped undercarriage 114. The opposing legs 110A and 110B are flared outwardly. To maintain proper alignment of the legs 110A and 110B, each is formed with an upturned flange 111A and 111B that protrudes upward directly in front of the T-shaped undercarriage 114. In addition to maintaining proper alignment of the legs 110A and 110B, the flanges 111A and 111B lock the legs 110A and 110B in position when the wing nuts 112A and 112B are tightened. As can be seen, the T-shaped undercarriage 114 is preferably formed with an angle to extend the forward section downwardly from the caulk gun.

Figure 14:
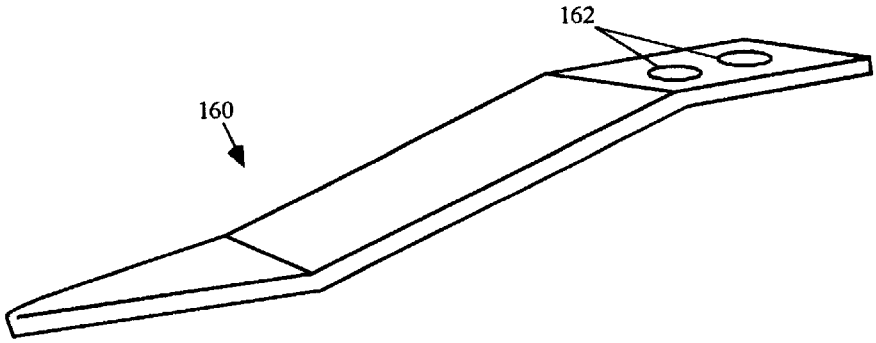
FIG. 14 is a perspective view of a guide member 160 that is suited for guiding the nozzle along concrete structures and windows.
Figure 15:
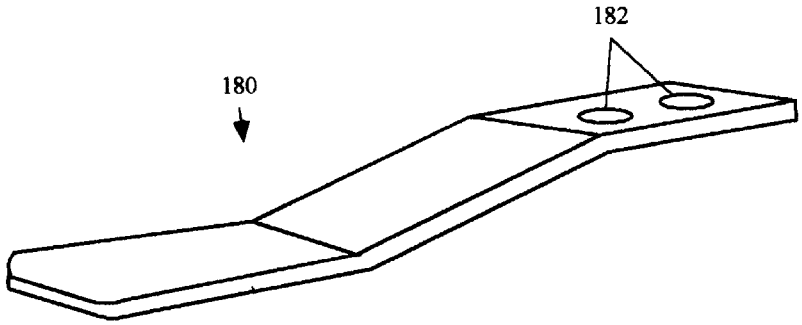
FIG. 15 is a is a perspective view of a guide member 180 that is better suited for guiding the nozzle along lap-seal roofing.
Figure 16:
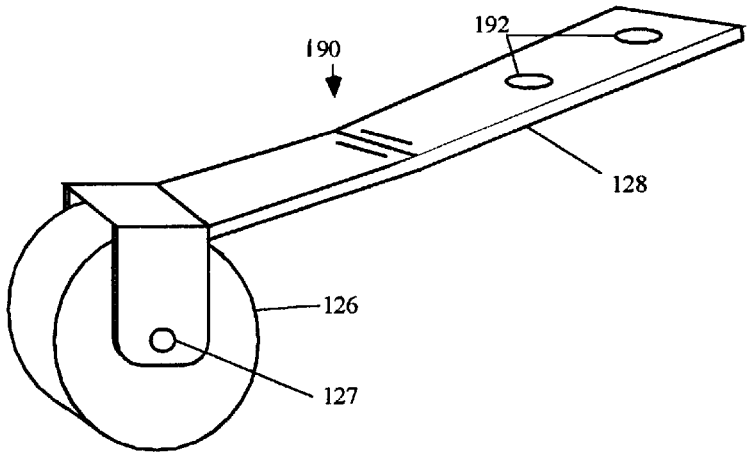
FIG. 16 is a perspective view of a rolling guide member 190 that is suited for guiding the nozzle along all types of surfaces.

FIGS. 14–16 are perspective drawings of three additional guide members 160, 180 and 190 that are interchangeable with the guide assembly 90, each being designed to follow a different structural component. Specifically, FIG. 14 is a perspective view of a guide member 160 that is suited for guiding the nozzle along concrete structures and windows. The guide member 160 is formed from a steel section as a forwardly projecting tongue that angles downward in advance of the nozzle and along the component or surface to which compound is being applied. Concrete and window applications typically provide good sliding surfaces and require exacting precision to apply a watertight seals. For this reason the distal end of the guide member reaches a sharp apex. Again, the forwardly projecting guide member 160 helps to steer the gun when it is necessary to follow a joint, line or roofing seam, said member 160 projecting there against to direct application of the bead of caulk.

FIG. 15 is a is a perspective view of a guide member 180 that is better suited for guiding the nozzle along lap-seal roofing. The guide member 180 is formed from a steel section as a forwardly projecting tong that angles downward in advance of the nozzle and along the component or surface to which compound is being applied. Roofing work typically involves rough sliding surfaces, and for this reason the distal end of the guide member is slightly concave and the periphery is rounded to facilitate sliding. The forwardly projecting guide member 180 helps to steer the gun when it is necessary to follow a joint, line or seam, said member 180 projecting there against to direct application of the bead of caulk.

FIG. 16 is a perspective view of a rolling guide member 190 that is suited for guiding the nozzle along all types of surfaces. The guide member 190 is again formed from a steel bracket 128 that projects forwardly and downwardly in advance of the nozzle to opposing struts. A roller 126 is rotatably supported on an axle 127 that is supported between the struts of bracket 128. The roller 126 tends to maintain a linear course as it rolls along a flat surface thereby helping to steer the gun to direct application of the bead of caulk.

All of the guide members 90, 160, 180 and 190 of FIGS. 14-16 may be attached to the underside of the dispensing gun by conventional anchoring devices such as thumbscrews through aligned bore holes 132, 162, 182 and 192 and into the underside of the dispensing gun. Alternatively, the guide members 90, 160, 180 and 190 may be adapted to fit a mating receptacle mounted on the front end of the caulk gun as described in previous embodiments, inclusive of a locking detent mechanism to secure the guide member in position.

All of the above-described guide assemblies with multiple interchangeable guide members facilitates quick and easy adaptation for different types of jobs and different types of building components. This flexibility eliminates the need for multiple dedicated guides and reduces the burden of carrying the same and/or the risk of lost parts. Moreover, all of the guides can be readily retrofit to an existing caulk gun and readily removed for use of the gun without the guides.

Having now fully set forth the preferred embodiments and certain modifications of the concept underlying the present invention, various other embodiments as well as certain variations and modifications thereto may obviously occur to those skilled in the art upon becoming familiar with said underlying concept. For example, although the invention is shown in the context of a conventional closed-frame half-barrel extended dispensing gun, it should be appreciated that the invention is equally suited for open-frame guns and/or with parallel frame guns (in vertical or horizontal format), and that the sizes of the barrel assemblies and cartridges may be easily varied. It is to be understood, therefore, that the invention may be practiced otherwise than as specifically set forth herein.

I claim:

1. A dispensing device, comprising:

a housing having a downwardly extending handle;

a first barrel assembly attached to said housing for accommodating one size of cartridge;

a piston rod slidably supported in said housing and protruding into said larger barrel assembly;

a trigger pivoted to said housing and retractable against said handle for advancing said piston rod; and a second barrel assembly adapted to be seated piggyback inside said larger barrel assembly for accommodating another size of cartridge;

whereby said piggyback barrel assembly makes it possible to use the dispensing device for at least two different types of cartridges.

2. The piggyback dispensing device according to claim 1, further comprising an interchangeable push-disk piston mounted on the distal end of said piston rod for urging caulking composition from one of said cartridges.

3. The piggyback dispensing device according to claim 1, wherein said second barrel assembly further comprises a bracing assembly for securing it within said larger barrel assembly.

4. The piggyback dispensing device according to claim 3, wherein said bracing assembly further comprises a stabilizer bar attached perpendicularly at one end of said second barrel assembly for lateral stability.

5. The piggyback dispensing device according to claim 3, wherein said bracing assembly further comprises a spring-loaded extension at one end of said second barrel assembly for lengthwise stability against the front of the first barrel assembly.

6. The piggyback dispensing device according to claim 1, wherein said second barrel assembly further comprises a coupling for securing a push-disk piston thereon.

7. The piggyback dispensing device according to claim 6, wherein said coupling is a threaded stud for screw insertion into a threaded collar on said push-disk piston, said stud being adjustably screwed into the underside of the second barrel assembly and also serving as an adjustable vertical spacer between the first barrel assembly.

8. The piggyback dispensing device according to claim 1, further comprising a receptacle mounted underneath the forward end of said first barrel assembly, and a guide assembly removably inserted in said receptacle and projecting forwardly of said dispensing device for guiding application of compound.

9. The piggyback dispensing device according to claim 1, wherein said piston rod further comprises a plurality of sections joined by a coupling.

10. The piggyback dispensing device according to claim 1, wherein said piston rod, push-disk piston, and first and second barrel assemblies are all easily disassembled for convenient replacement of worn parts.

11. A piggyback dispensing device, comprising:

a housing having a downwardly extending handle;

an extension bracket attached forwardly of said housing;

a larger barrel assembly attached to said extension bracket opposite said housing;

a piston rod slidably supported in said housing and extension bracket and protruding into said larger barrel assembly;

an interchangeable push-disk piston mounted on the distal end of said piston rod for urging caulking composition from a cartridge;

a trigger pivoted to said housing below said plunger shaft and retractable against said handle for advancing said piston rod; and a smaller barrel assembly adapted to be seated inside said larger barrel assembly to accommodate a smaller-sized cartridge.

12. The piggyback dispensing device according to claim 11, wherein said second barrel assembly further comprises a bracing assembly for securing it within said larger barrel assembly.

13. The piggyback dispensing device according to claim 12, wherein said bracing assembly further comprises a stabilizer bar attached perpendicularly at one end of said second barrel assembly for lateral stability.

14. The piggyback dispensing device according to claim 12, wherein said bracing assembly further comprises a spring-loaded extension at one end of said second barrel assembly for lengthwise stability against the front of the first barrel assembly.

15. The piggyback dispensing device according to claim 11, wherein said smaller barrel assembly further comprises a coupling for securing a push-disk piston thereon.

16. The piggyback dispensing device according to claim 15, wherein said coupling is a threaded stud for screw insertion into a threaded collar on said push-disk piston, said stud being adjustably screwed into the underside of the second barrel assembly and also serving as an adjustable vertical spacer between the first barrel assembly.

17. The piggyback dispensing device according to claim 11, further comprising a receptacle mounted underneath the forward end of said first barrel assembly, and a guide assembly removably inserted in said receptacle and projecting forwardly of said dispensing device for guiding application of compound.

18. The piggyback dispensing device according to claim 11, wherein said piston rod further comprises a plurality of sections joined by a coupling.

19. The piggyback dispensing device according to claim 11, wherein said piston rod, push-disk piston, and first and second barrel assemblies are all easily disassembled for convenient replacement of worn parts.

20. An improved adjustable guide assembly for a dispensing gun, comprising:

a stem section for attachment to the barrel-end of a caulk gun, said stem section having a detent mechanism proximate a distal end for quick-release, and two sets of opposing arms projecting outardly and forwardly from said stem section; and a receptacle mounted on said dispensing gun for slidable insertion of the stem section, the detent mechanism of the stem section cooperating with the receptacle to allow a quick-change swapping out.

21. An adjustable guide assembly for a conventional dispensing gun, comprising:

a stem section for attachment to the barrel-end of a caulk gun, a pair of opposing arms projecting outwardly from said stem section;

a pair of adjustable legs, each of said legs being slidably secured along a corresponding arm and adjustable there along to allow said legs to straddle components of various sizes.

22. The adjustable guide assembly according to claim 21, further comprising a guide member projecting forwardly of said stem section for guiding application of a bead of compound from said dispensing gun.

23. A quick-change guide assembly for a conventional dispensing gun, comprising:

a guide assembly including an upper guide having opposing legs separated by a sufficient measure to ride along a single joist, a back-to-back lower guide assembly having opposing legs separated by a sufficient measure to ride along a double joist, an undercarriage for mounting said upper and lower guides, and a detent mechanism mounted in said undercarriage;

a receptacle mounted on said conventional dispensing gun for slidable insertion of the guide assembly, the detent mechanism of the guide assembly cooperating with the receptacle to allow a quick-change reversal of the guide assembly to accommodate either a single joist or a double joist position.

* * * * *